US011235547B2

(12) United States Patent
Ulrich

(10) Patent No.: US 11,235,547 B2
(45) **Date of Patent: *Feb. 1, 2022**

(54) CORNER BOARDS, CONTAINER ASSEMBLIES INCLUDING THE SAME, AND METHODS OF MAKING AND USING THE SAME

(71) Applicant: Sierra Packaging Solutions, Kingsburg, CA (US)

(72) Inventor: Clyde Ulrich, Kingsburg, CA (US)

(73) Assignee: Sierra Packaging Solutions, Kingsburg, CA (US)

( * ) Notice: Subject to any disclaimer, the term of this patent is extended or adjusted under 35 U.S.C. 154(b) by 1629 days.

This patent is subject to a terminal disclaimer.

(21) Appl. No.: 14/690,183

(22) Filed: Apr. 17, 2015

(65) Prior Publication Data

US 2015/0307230 A1 Oct. 29, 2015

Related U.S. Application Data

(60) Provisional application No. 61/984,676, filed on Apr. 25, 2014.

(51) Int. Cl.

| | |
|---|---|
| ***B31D 5/00*** | (2017.01) |
| ***B65D 81/05*** | (2006.01) |
| ***B65B 13/18*** | (2006.01) |

(52) U.S. Cl.

CPC ..... *B31D 5/0004* (2013.01); *B65D 81/054* (2013.01); *B65B 13/181* (2013.01); *B65D 2581/053* (2013.01)

(58) Field of Classification Search

CPC ..... B65D 81/054; B65D 2581/053; B65D 21/0224

USPC ..... 206/586

See application file for complete search history.

(56) References Cited

U.S. PATENT DOCUMENTS 5,065,972 A * 11/1991 Buckshaw ..... A47B 95/043 206/586
5,758,470 A 6/1998 Lancaster, III
5,813,537 A 9/1998 DeReu et al.

(Continued)

OTHER PUBLICATIONS

Written Opinion of the International Searching Authority dated Dec. 3, 2013 for International Application No. PCT/US2013/046887; 7 pgs.

*Primary Examiner* — Anthony D Stashick
*Assistant Examiner* — James M Van Buskirk
(74) *Attorney, Agent, or Firm* — Andrew D. Fortney; Central California IP Group, P.C.

(57) ABSTRACT

A corner board includes first and second sides, each including a board material; a bend between first and second sides, joining the sides together; and a slit adjacent to a first end of the corner board forming a first flap adapted to place the corner board on a container or a stack of containers or otherwise couple the corner board to horizontal and vertical surfaces of the container or stack of containers. A method of manufacturing a corner board includes bending a board stock to form first and second sides of the corner board with an angle therebetween; cutting the board stock into fixed lengths, the bent and cut board stock forming the corner board; and forming a slit near a first end of the corner board, in which the slit creates a first flap adapted to couple the corner board to a container or a stack of containers.

20 Claims, 9 Drawing Sheets

(56) References Cited

U.S. PATENT DOCUMENTS

| | | | | |
|---|---|---|---|---|
| 6,012,587 | A * | 1/2000 | McCullough | B65D 71/0096 206/453 |
| 8,046,975 | B1 | 11/2011 | Bison | |
| 9,169,063 | B2 * | 10/2015 | Ulrich | B65D 90/08 |
| 2011/0180450 | A1 | 7/2011 | Hainer | |
| 2011/0278198 | A1 | 11/2011 | Hazell | |
| 2013/0320030 | A1 * | 12/2013 | Ulrich | B65D 90/08 220/652 |

* cited by examiner

CORNER BOARDS, CONTAINER ASSEMBLIES INCLUDING THE SAME, AND METHODS OF MAKING AND USING THE SAME

RELATED APPLICATIONS

This application claims the benefit of U.S. Provisional Patent Application No. 61/984,676, filed Apr. 25, 2014, which is incorporated herein by reference in its entirety.

FIELD OF THE INVENTION

The present invention generally relates to the field of corner boards and methods of making and using the same. More specifically, embodiments of the present invention pertain to a corner board with bendable flaps located near an end thereof, and methods of manufacturing and using such corner boards.

DISCUSSION OF THE BACKGROUND

Containers are used for holding and/or storing materials. Multiple containers can be stacked together as a single unit for various reasons, such as storage, transportation, or other operations involving multiple containers. For instance, multiple containers may be placed onto a pallet, for storage in a warehouse and/or loading onto a trailer for transportation (e.g., from a distribution warehouse to a store). When moving a pallet of containers by forklift, the forklift operator may inadvertently strike the edge of the pallet into a wall, shelving bracket, vehicle or even other container(s). Unexpected movement during transportation of the containers can also cause stacks to become unstable or fall, or otherwise become damaged. As a result, the manipulation of such containers or container stacks may result in damage to the exterior of the container(s) and/or the contents therein.

Corner boards may be placed on corners of container stacks to hold the stacks in place and/or mitigate damage to the containers. Conventionally, corner boards are attached to the exterior edges of the container stacks using staples or tape. However, these methods for attaching corner boards are relatively time-consuming and require additional materials to be used with the corner boards. Further, these methods of attaching corner boards may create safety risks; for example, a person could become injured from the staple(s) that may protrude from the corner board when removing the stapled corner board(s) from the group of containers, or be cut when cutting the tape with a knife or box cutter. These methods for affixing corner boards may also damage the container(s) and/or their contents. For example, the staple used to attach the corner board may pierce the contents within the underlying container, or the tape may tear the exterior surface of the container, which frequently has a protective, moisture resistant or finished/decorative outer surface. Therefore, it is desirable to provide a corner board in which the corner board is easily placed on a container stack without the need to use additional means to affix the corner board to the container(s).

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY OF THE INVENTION

Embodiments of the present invention relate to a corner board that advantageously holds container stacks in place, eliminates and/or minimizes damage to the containers, and reduces or minimizes expenses due to damaged containers and/or container contents. In addition, the present corner board eliminates the need for costly corner board attachment materials and the risks associated with such attachment materials.

One aspect of the present invention relates to a corner board, comprising first and second sides, each including a board material; a bend between the first and second sides, joining the first and second sides together; and at least one slit adjacent to or in a first end of the corner board, forming a first flap adapted to place, set or rest the corner board on a container or stack of containers. Various embodiments of the present invention include first and second slits adjacent to or in the first end of the corner board, forming first and second flaps adapted to place, set or rest the flaps on a horizontal or substantially horizontal surface of the container or stack of containers, and the first and/or second sides on a vertical or substantially vertical surface of the container or stack of containers. The flap(s) extend inward from the outer edge(s) of the corner board. In some embodiments, the slits are in (and the flaps are formed along) an outer edge of the first and second sides of the corner board. In other embodiments, the slits are in (and the flaps are formed along) a common edge (e.g., the first end) of the corner board.

Another aspect of the present invention relates to a method of manufacturing a corner board that includes bending a board stock to form first and second sides of the corner board, the first and second sides having an angle therebetween; cutting the board stock into fixed lengths, the bent and cut board stock forming the corner board; and forming at least one slit in or near a first end of the corner board creating a flap adapted to rest or seat the corner board on a substantially horizontal surface. Further embodiments of the method include creating the flaps by pushing the bent board stock between the slit and the edge of the corner board inward (e.g., relative to the angle).

A further aspect(s) of the present invention relates to an apparatus for forming a slit corner board that simultaneously cuts the board stock and forms the slit. In various embodiments of the apparatus, an attachment is configured to form the flap(s) simultaneously with or immediately after cutting the board stock and/or forming the slit(s). An additional aspect of the present invention relates to a method of securing a plurality of stacked containers using the present corner board.

These and other advantages of the present invention will become readily apparent from the description of various embodiments below.

DETAILED DESCRIPTION

Figure 1A:
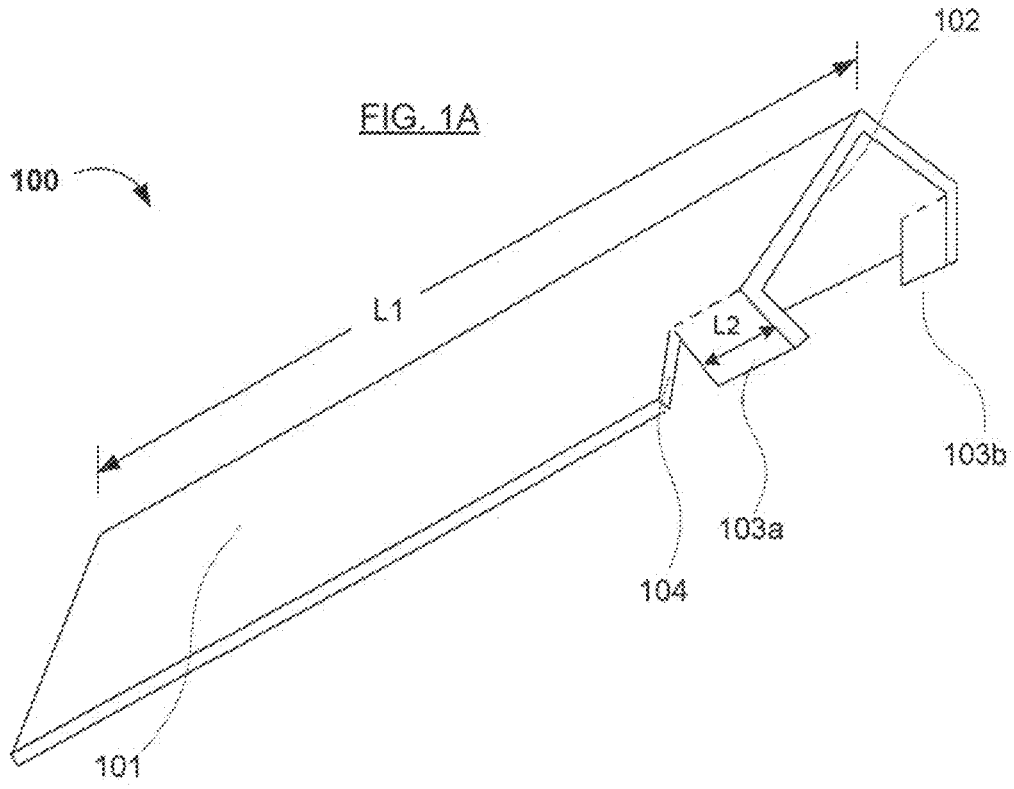
FIG. 1A is a perspective view of an exemplary corner board according to one or more embodiments of the present invention.

Reference will now be made in detail to various embodiments of the invention, examples of which are illustrated in the accompanying drawing(s). In order to achieve the objectives, technical solutions and advantages of the present invention more clearly, further details of the invention are described below with regard to the Figure(s). While the invention will be described in conjunction with the following embodiments, it will be understood that the descriptions are not intended to limit the invention to these embodiments. On the contrary, the invention is intended to cover alternatives, modifications and equivalents that may be included within the spirit and scope of the invention as defined by the appended claims. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures, components, and attachment equipment have not been described in detail so as not to unnecessarily obscure aspects of the present invention. The embodiments described here are only used to explain, rather than limit, the invention.

In the context of this application, and for the sake of convenience and simplicity, the terms corner board, cornerboard, edge board, edgeboard, angle board, and angleboard may be used interchangeably herein, and use of one such term generally includes the others, unless indicated otherwise from the context of its use herein.

Thus, technical aspects of embodiments of the present invention will be more fully and clearly described in conjunction with the drawings in the following embodiments. It will be understood that the descriptions are not intended to limit the invention to these embodiments. Based on the described embodiments of the present invention, other embodiments can be obtained and/or derived by one skilled in the art without creative contribution or effort, and are considered within the scope of legal protection given to the present invention.

Furthermore, all characteristics, measures or processes disclosed in this document, except characteristics and/or processes that are mutually exclusive, can be combined in any manner and in any combination possible, either with each other or with structures in the prior art. Any characteristic disclosed in the present specification, claims, Abstract and Figures can be replaced by other equivalent characteristics or characteristics with similar objectives, purposes and/or functions, unless specified otherwise.

Embodiments of the present invention can advantageously provide a corner board that may be rested or placed along a vertical edge of a container or stack of containers, without the need for additional material or steps (e.g., staples or tape) for affixing the corner board to the container or stack. These and other advantages of the present invention will become readily apparent from the description below.

Exemplary Corner Board(s)

FIG. 1A illustrates an exemplary corner board 100 according to the present invention. In a first aspect of the present invention, the corner board 100 (which may also be known as a v-board, edge board, edge protector, corner post, ag board, protecting or protectant edge, angle board or other similar term) may comprise a stiff, angled piece of material. In various embodiments of the present invention, slits (e.g., slit 104) may be created in the main body of corner board 100 to create bendable flaps 103*a* and 103*b*. Incisions to create such slits can be made near or adjacent to one end of the board 100 such that the flaps 103*a* and 103*b* are between the slit 104 and end of the corner board. As illustrated in FIG. 1A, flaps 103*a* and 103*b* generally extend inward from the main body of corner board 100.

With further reference to FIG. 1A, the corner board 100 may be formed from any material, such as paper, cardboard, pressboard, plastic, or any laminate or other combination thereof that has or can have a predetermined minimum stiffness. However, laminated paper, plastic or a combination thereof (such as commingled plastic) having a predetermined minimum stiffness is generally preferred. The listed materials comprise broad categories. For instance, "cardboard" may comprise any board material comprising paper and/or fiber, such as pressed and/or corrugated cardboard, fiberboard, paperboard, boxboard and/or containerboard. The corner board 100 may further comprise an overwrap (e.g., paper) and/or a laminate of cardboard and another material (such as plastic). In further embodiments, the overwrap may comprise either a full overwrap or a partial overwrap (e.g., with edges of the corner board being exposed). In some embodiments, the laminate may comprise one or more layers of paper and/or cardboard and one or more sheets or layers of plastic and/or wax.

In the embodiment of FIG. 1A, the corner board 100 comprises a plurality of sides. Generally, the corner board 100 has two sides 101, 102. Each side 101, 102 of the corner board 100 is generally rectangular. However, in other embodiments, the sides of the corner board can be square, triangular, trapezoidal, or any other suitable shape.

Figure 1B:
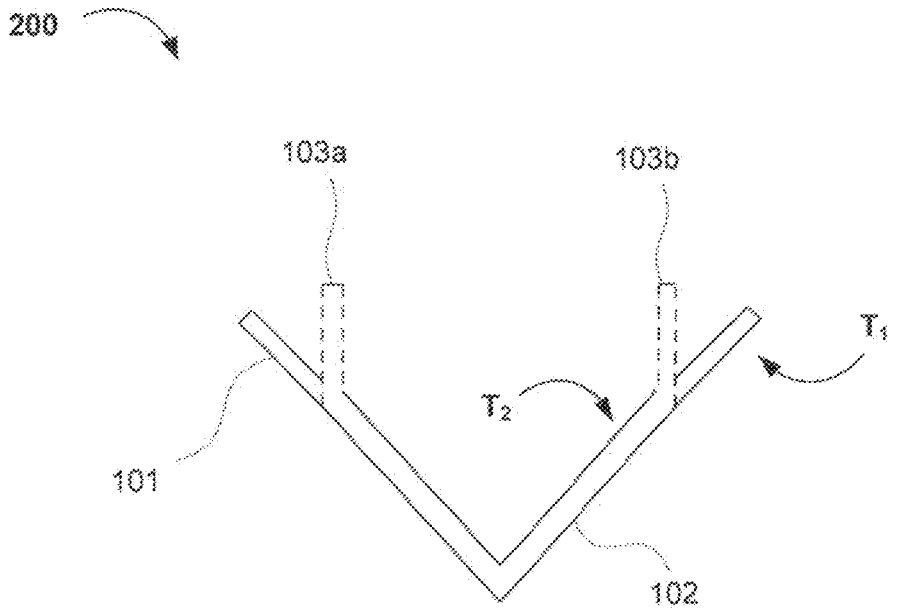
FIG. 1B is a perspective view of an exemplary corner board according to one or more further embodiments of the present invention.

The corner board 100 can have any thickness suitable for protecting the edge of a container and/or group (e.g., stack) of containers. In some embodiments, the thickness of the corner board 100 may be the same thickness as the material used to create the corner board 100. In one embodiment, the corner board 100 may have a thickness of about 0.16 in. (0.4 cm). In other embodiments, the thickness can be in the range of 0.08 in. (about 0.2 cm) to 0.50 in. (about 1.3 cm), and can include a thickness of about 0.12 in. (0.3 cm), 0.2 in. (0.5 cm) or 0.25 in. (0.6 cm). Alternatively, the corner board 100 can have an inner thickness $T_2$ less than an outer thickness $T_1$ (see, e.g., U.S. Pat. No. 5,813,537, which discloses a so-called "apex" board), or alternatively, greater than the outer thickness $T_1$, as shown in FIG. 1B. For example, $T_2$ may be in the range of 0.12 in. to 0.50 in. (e.g., about 0.16 in.), and $T_1$ may be in the range of 0.08 in. to 0.375 in. (e.g., about 0.12 in.), or vice versa.

With further reference to FIG. 1A, length L1 of the sides 101, 102 of the main body 105 of the corner board 100 may be any length suitable for protecting the edge of a container and/or group of containers. In preferred embodiments, the length L1 of the sides 101, 102 of the corner board 100 is about 24 in. (60 cm) to about 90 in. (230 cm). However, it should be readily understood that the length L1 of the sides 101, 102 of the corner board 100 can be any value in the range, or more or less than such a range. For example, the length L1 may be about 20 cm to about 600 cm. In general, the thicker the corner board 100, the greater the length L1. For example, when the corner board 100 has a length of about 24 in. (60 cm) to 36 in. (90 cm), the thickness may be from about 0.12 in. (0.3 cm) to about 0.2 in. (0.5 cm). When the corner board 100 has a length of about 36 in. (90 cm) to 48 in. (120 cm), the thickness may be from about 0.16 in. (0.4 cm) to about 0.25 in. (0.625 cm). Furthermore, when the corner board 100 has a length of about 48 in. (120 cm) to 72 in. (180 cm), the thickness may be from about 0.25 in. (0.625 cm) to about 0.5 in (1.25 cm). In this manner, the length L2 of the flaps 103*a*, 103*b* may be relative to the length L1 of the corner board 200 (or of the sides 101, 102 thereof), as discussed supra. Accordingly, the length L2 of the flaps 103*a*, 103*b* may also be suitable for protecting the edge of a container and/or group of containers, and facilitating support for a stack of containers.

Figure 2:
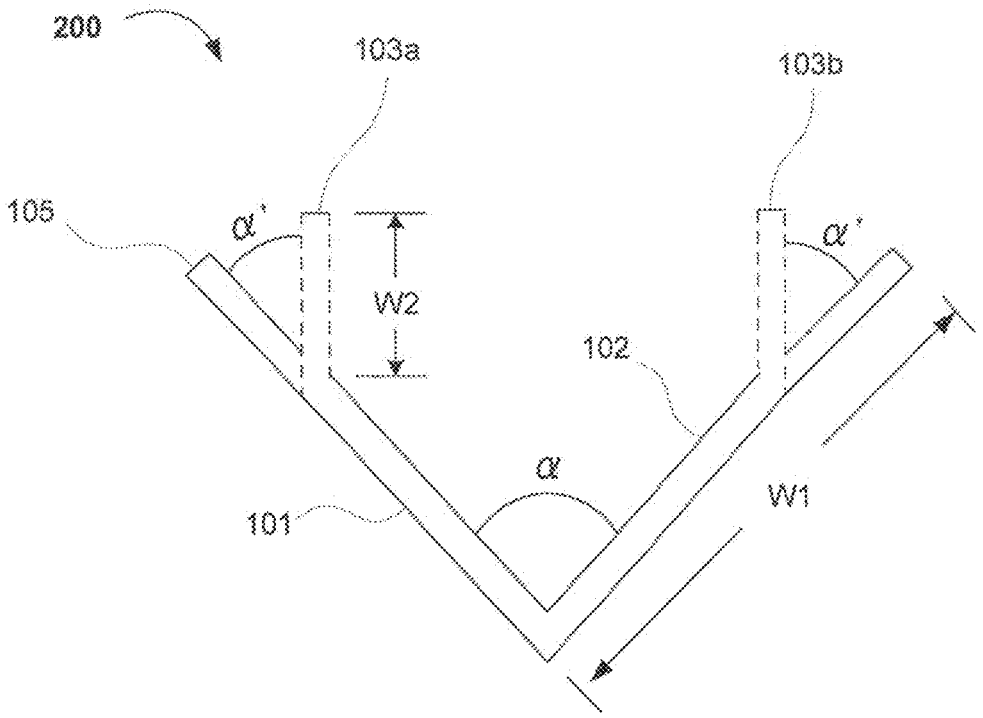
FIG. 2 is an end view of the corner board according to FIG. 1.

Referring to FIG. 2, a width W1 of the sides 101, 102 of the corner board 200 may be any width suitable for protecting the edge of a container and/or group of containers, and facilitating support for a stack of containers. In preferred embodiments, the width W1 of each side 101, 102 of the corner board 200 is about 1 in. (2.5 cm) to about 4 in. (10 cm). However, it should be readily understood that the width W1 of the sides 101, 102 of the corner board 200 can be any value in the range, or more or less than such a range. In this manner, the width W2 of the flaps 103*a*, 103*b* may be relative to the width W1 of a side of the corner board 200, as discussed supra. Accordingly, the width W2 of the flaps 103*a*, 103*b* may also be suitable for protecting the edge of a container and/or group of containers, and facilitating support for a stack of containers.

Referring back to FIG. 1A, flaps 103*a*, 103*b* as shown on the corner board 100 may have any suitable width and length, and the slits 104 may be located any suitable and/or predetermined distance from the end of the corner board 100, while still allowing the corner board 100 to rest on and/or contact the container (as subsequently shown in FIG. 5A), stack of containers, and/or a vertical edge of the container or stack of containers. Also, the longer the corner board 100, generally the greater the length L2 of the flaps 103*a*, 103*b*. Similarly, the thicker the corner board, generally the greater the length L2 of the flaps 103*a*, 103*b*. For example, when the corner board 100 has a length of about 24 in. (60 cm) to 48 in. (120 cm), the length L2 may be from about 0.12 in. (0.3 cm) to about 0.5 in. (1.3 cm). When the corner board 100 has a length of about 48 in. (120 cm) to 60 in. (150 cm), the length L2 may be from about 0.375 in. (0.95 cm) to about 1.0 in. (2.5 cm).

Flaps 103*a*, 103*b* may comprise a portion of and/or the material of the main body of corner board 100. As shown in FIG. 2, the flaps 103*a*, 103*b* may each be at a respective angle (e.g., angle α') relative to the main body 105 of the corner board 100. Generally, the flaps 103*a*, 103*b* extend inward relative to main body 105 and towards an angled bend of corner board 200 (e.g., angle α) such that angles α and α' about 180° or less (e.g., from 135° to 210°). Although FIG. 2 depicts flaps 103*a*, 103*b* sharing similar angles, these angles may be positioned independent of one another. As such, flaps 103*a*, 103*b* may be positioned in any manner relative to the main body 105 of the corner board 100 that has the capability and adjustability to hang and/or stay on the end of the corner board 100.

Figure 3:
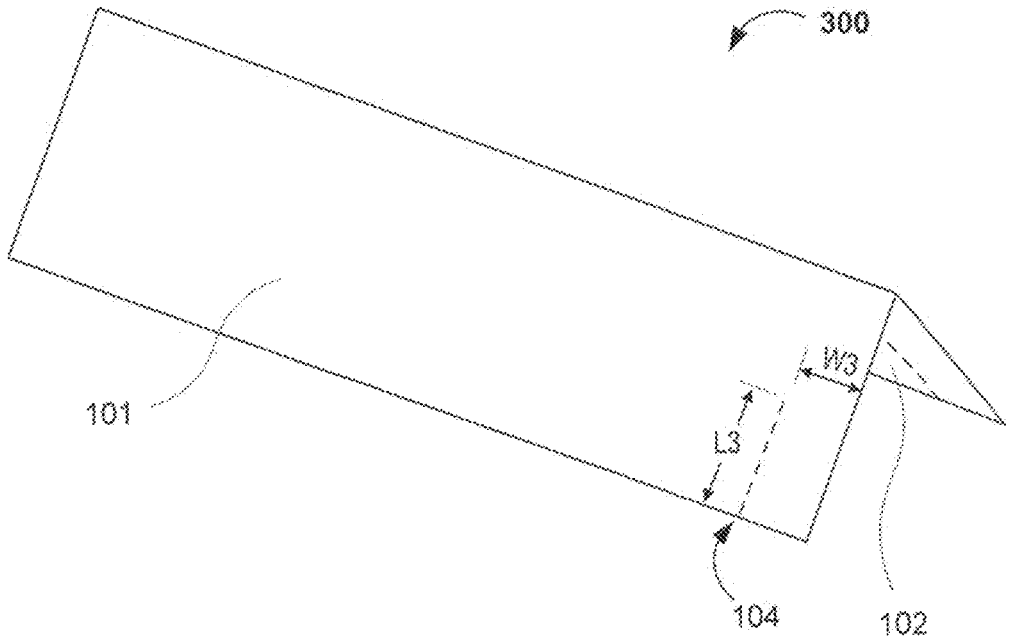
FIG. 3 is a side view of an exemplary corner board prior to the creation of flaps according to one or more embodiments of the present invention.

Referring to FIG. 3, a distance (W3) from the end of the corner board 300 to the slit 104, where flaps 103*a*, 103*b* can be created in the main body of corner board 100 may vary, depending on the type and/or thickness of material used to create the corner board 100. For example, width W3 of FIG. 3 may be from about 0.12 in. to about 1 in. (e.g., about 0.3 cm to about 2.5 cm). In one embodiment, the predetermined distance (W3) from the slit 104 to the end of the corner board is about 0.37 in. (e.g., about 1 cm) when the corner board 100 has a thickness of about 0.16 in. (e.g., 0.6 cm) or greater. In various embodiments, the predetermined distance (W3) from the slit 104 to the end of the corner board may be about 0.5 cm to about 2 cm, especially when the corner board has a thickness of about 0.6 cm or greater. However, one skilled in the art will readily understand that the distance can be any suitable distance that achieves the objectives of the present invention. In further embodiments, when the corner board 100 is less than 0.16 in. (e.g. 0.6 cm), the slit 104 may be 0.63 in. (e.g. about 1.5 cm) from the end of the corner board 100. In further embodiments, the predetermined distance (W3) from the slit 104 to the end of the corner board may be about 0.75 cm to about 3 cm when the corner board has a thickness of less than 0.6 cm.

The length and/or depth (L3) of the slit 104 (and thus of flaps 103*a*, 103*b*) may be any suitable value that allows or provides for the corner board 100 to rest on one or more containers. Generally, the depth (L3) of the slit 104 is a predetermined percentage of the width W1 (see FIG. 2) of each side 101, 102 of the corner board 100. For example, the depth (L3) of the slit 104 may be from 20-80% of the width W1 of each side of the corner board 100, or any value or range of values therein (e.g., 30-60%, about 50%, etc.), preferably 30-50% of the width of each of the first and second sides 101, 102. Typically, first and second sides 101, 102 have identical widths.

Furthermore, the angle α of the corner board 100 and the angles α' of the flaps 103*a*, 103*b* may depend on the shape of the container and/or stack of containers. Generally, the angles of the corner board 100 and flaps 103*a*, 103*b* can be any value that provides or allows for the corner board 100 to rest on and/or against the corner of a container. The angle of flaps 103*a*, 103*b* should be proportional to the angle of a commercially available container(s). For instance, an angle α' of 180° or less (e.g., from 135° to 210°) is generally preferred, whereas an angle α of about 90 degrees is generally preferred.

Figure 4A:
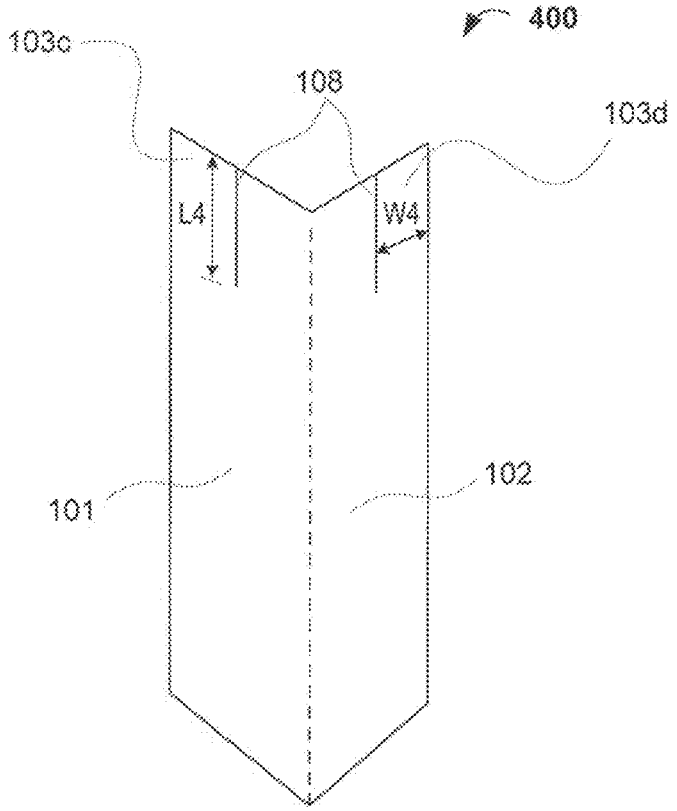
FIG. 4A is a side view of another exemplary corner board prior to the creation of flaps according to one or more further embodiments of the present invention.

Referring now to FIG. 4A, in another embodiment, one or more slits 108 can be created in the end of the board such that flaps 103*c*, 103*d* can be folded downwards (e.g., away from one end of corner board 100 and towards the opposite end). As depicted in FIG. 4A, and similar to the corner board illustrated in FIG. 3, a distance (W4, or width of the flap 103*d*) from an outer or long edge of the side 101 to the slit 108 may vary, depending on the type and/or thickness of material used to create the corner board 100. Also, similar to the corner board illustrated in FIG. 3, the length and/or depth (L4) of the slits 108 (and thus of the flaps 103*c*, 103*d*) may be any suitable value that provides for the corner board 100 to rest on a corner of a container or stack of containers. Furthermore, the angle α between the sides 101 and 102 of the corner board 100, and the angles α' of the flaps 103*c*, 103*d* relative to the sides 101 and 102 of the corner board 100, may depend on the shape of the container and/or stack of containers.

Figure 4B:
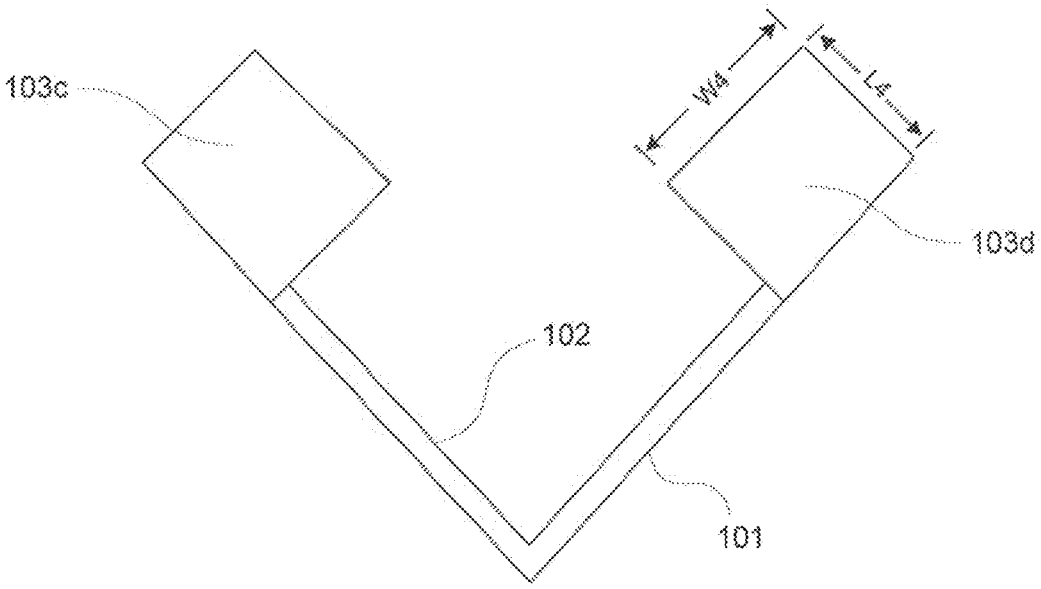
FIG. 4B is a perspective view of another exemplary corner board according to embodiment(s) of the present invention.

As shown in FIG. 4B, flaps 103*c*, 103*d* may each be bent or folded at a respective angle relative to a side (e.g., side 101, 102) of the corner board 100. Generally, the flaps 103*c*, 103*d* extend downwards such that their respective angles with respect to the side of the corner board 100 is about 90° or more (up to a maximum of about 150°, and more typically, up to about) 120°. As such, the flaps 103*c*, 103*d* may be positioned in any manner that provides the capability to stay or hang on the end of the corner board 100.

An Exemplary Stack of Containers Protected with Corner Boards

Figure 5A:
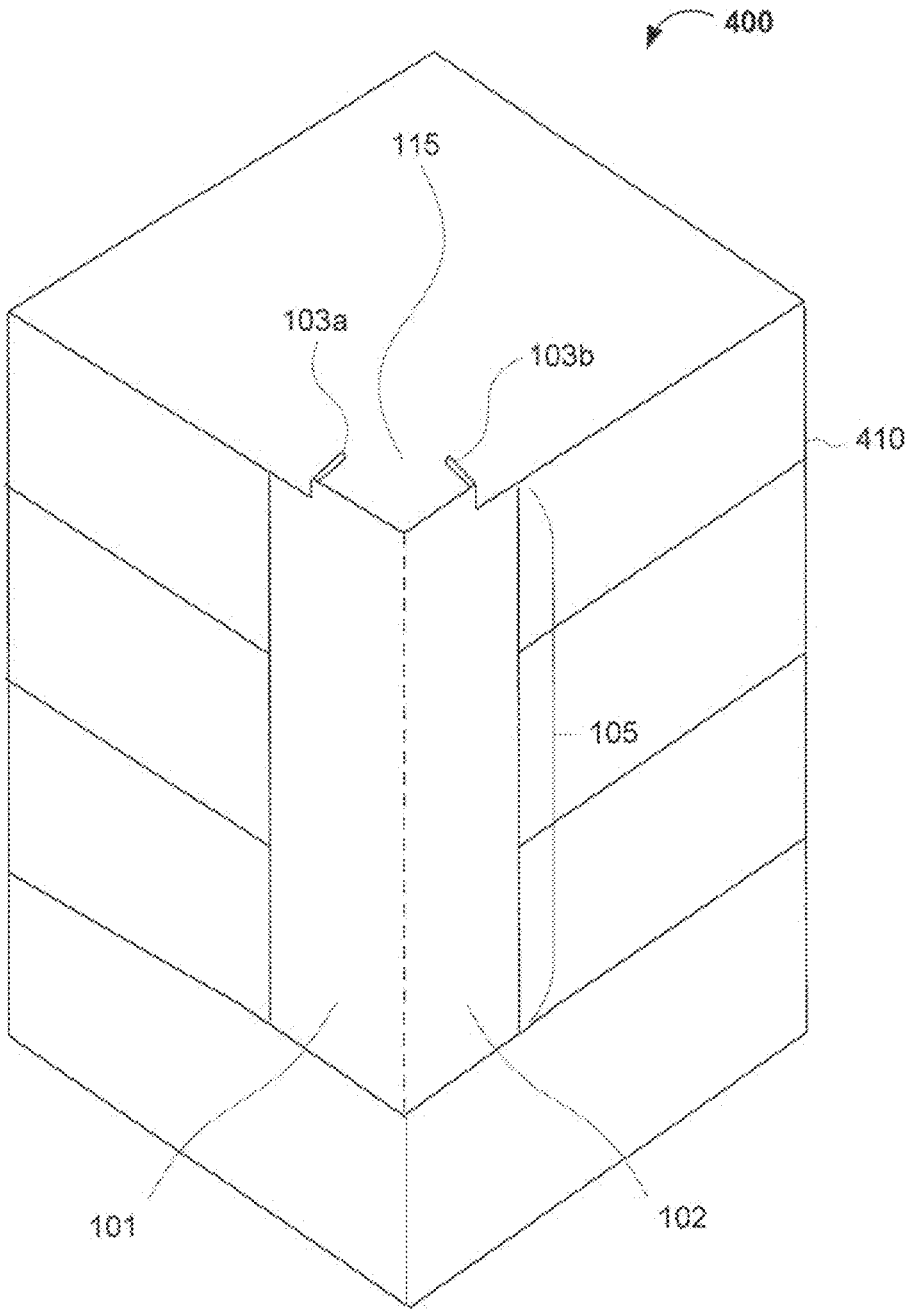
FIG. 5A is a perspective view of an exemplary corner board according to the present invention on a container stack.

FIG. 5A shows an exemplary use of the corner board 100 on a group of containers 410, in which the corner board 100 rests on the vertical edge of the group of containers 410. Alternatively, the corner board 100 may rest on the edge or corner of one or more items and/or objects (e.g., a stack or arrangement of items or objects, such as furniture), instead of the group of containers 410. To properly secure the stacked containers, flaps 103*a*, 103*b* of the corner board 100 are placed on an uppermost corner 115 of a stack of containers 410 in a position such that the main body 105 of the corner board 100 presses against or is in contact with the (vertical) edge of the stack of containers and/or surface(s) of the containers adjacent to that edge. For example, the sides 101, 102 of the corner board 100 generally rest on the sides of the container or stack of containers 410 adjacent to the edge of the stack of containers 410.

It will be readily understood by those skilled in the art that the corner board 100 can extend any suitable length along the edge of the group of containers 410. While the sides 101, 102 of the corner board 100 will generally be a length equal to or less than the length of the edge of the group of containers 410, it should be understood that the corner board 100 may be longer than the length of the edge of a single container and/or the group of containers 410. For instance, the corner board may have a length longer than the length of the vertical edge of a single container to protect the containers whose edges are generally vertically aligned with the container on which the corner board 100 is placed. In this manner, corner boards 100 may be placed on one or more containers (e.g., at each edge or at a subset of the edges) in a group of containers to mitigate damage to the edges of the containers in the group. The corner board 100 can also be useful for protecting other items or objects (e.g., furniture, bathroom/kitchen fixtures, windows, stacked building materials such as wood/boards, bricks, sheet rock, etc.).

The method may further comprise wrapping or banding the group of containers 410, or other stacked or grouped items and/or objects, together with the corner board(s) 100 in place with a wrapping, roping, or banding material. Wrapping, roping, or banding the group of containers generally improves the stability, handling, protection, and/or tamper resistance of the group of containers 410. It will be readily understood by those skilled in the art that the method may use any wrap, rope, band or strap suitable for use on the containers, items and/or objects to which it is applied. For instance, the wrap may comprise a stretch film, lay-flat film, roping film and/or strapping film, any of which may be solid or vented. Further still, the wrap, rope, and/or band may comprise shrink wrap, stretch film, roll(s) of stretch film on a spool, tape, one or more straps, one or more bands, net, rope, string, tarp, or any other suitable wrap (or combination of wraps and/or bands) for a group of (stacked) containers. Further still, the wrap, rope, or band may envelop any and/or every portion of the group of containers 410.

Figure 5B:
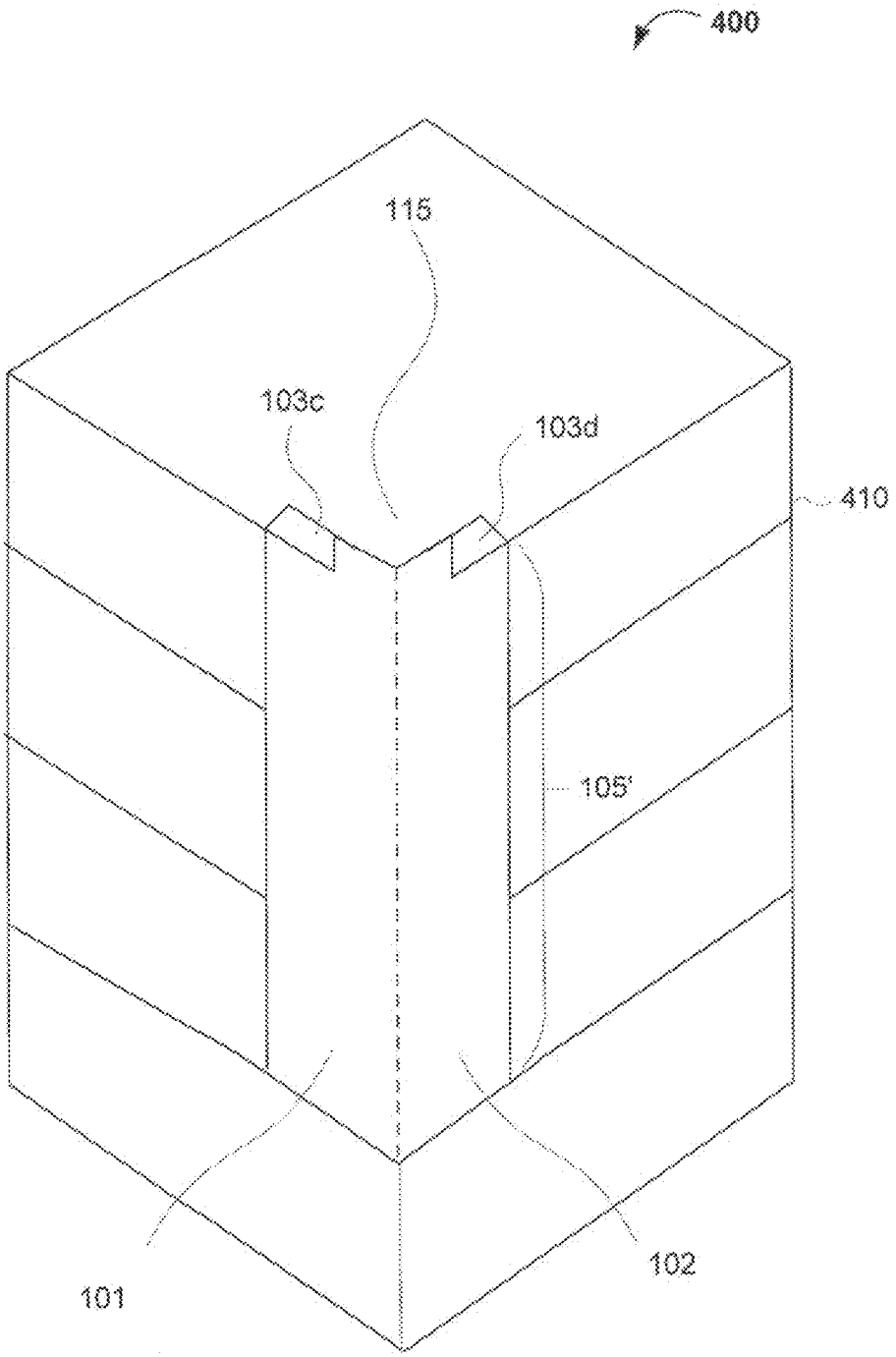
FIG. 5B is a perspective view of another exemplary corner board according to the present invention on a container stack.

FIG. 5B illustrates use of another embodiment of corner board 100 (e.g., corner board 400) positioned relative to a group of containers. As shown in FIG. 5B, the corner board 400 rests on the vertical edge of the group of containers 410 by folding flaps 103*c*, 103*d* downwards (e.g., away from the first end of the corner board 100 and towards the group of containers 410). Similar to the embodiment depicted in FIG. 5A, to properly secure the stacked containers, flaps 103*c*, 103*d* of the corner board 100 are placed on an uppermost corner 115 of a stack of containers 410 in a position such that the edge of the stack of containers and/or adjacent surface(s) is/are firmly pressed against the main body 105' of the corner board 100. Accordingly, the sides 101, 102 of the corner board 100 can rest on the sides of the stack of containers 410 adjacent to the edge of the stack of containers 410.

Exemplary Apparatuses for Manufacturing Slits or and/or Flaps for Corner Boards

Figure 6A:
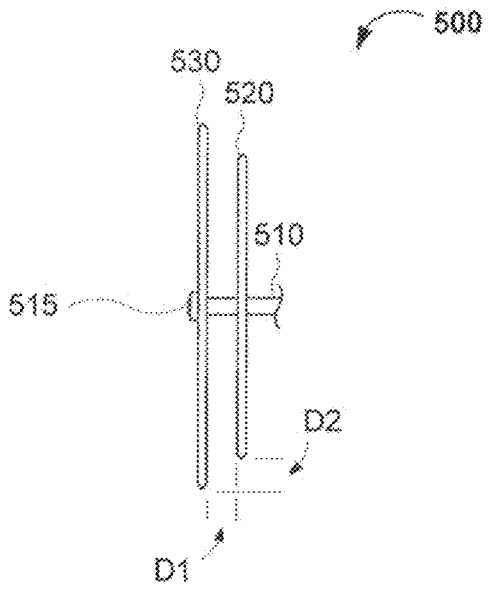
FIGS. 6A-6C are structural diagrams of an exemplary apparatus and/or exemplary parts of an apparatus for manufacturing the corner boards of FIGS. 1A-3, in accordance with the present invention.
Figure 6B:
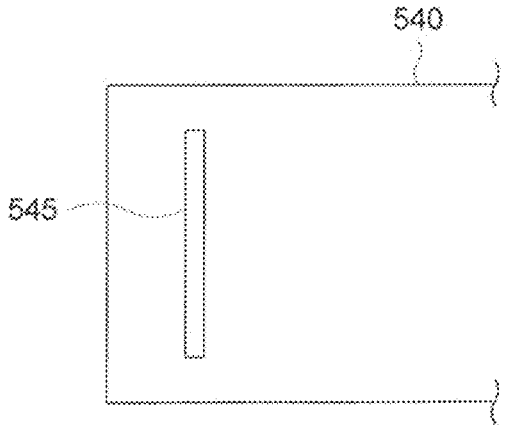

FIGS. 6A-6B are structural diagrams showing parts of equipment 500 for manufacturing the corner board of FIGS. 1A-3. FIG. 6A is an apparatus 500 for manufacturing the corner board of FIGS. 1A-B, FIG. 2 and/or FIG. 3.

FIG. 6A shows a side view of a first cutting device 530 and a second cutting device 520, both attached to a center shaft 510 and secured by bolt 515. In various embodiments, the board stock is cut and the slit creating flaps 103*a* and/or 103*b* can be formed simultaneously using a "dual purpose" cutting tool as shown in FIG. 6A. For example, the first cutting device 530 may be configured to cut board stock for the corner boards into individual sections. The first cutting device 530 may be, for example, a saw blade. Alternatively and/or additionally, the first cutting device may be selected from the group consisting of a knife blade, a laser, a saw (e.g., a radial saw), or a water jet. The first cutting device may be configured to cut board stock for the corner board into individual sections. The second cutting device 520 is configured to form slit 104 in the corner board near or adjacent to the cut end of the corner board 100, the slit creates a first flap adapted to couple the corner board to a surface. The second cutting device 520 may be selected from the group consisting of a knife blade, a laser, a saw blade (e.g., a radial saw), and/or a water jet.

Generally, the second cutting device 520 is offset and/or spaced apart from the first cutting device 530 by a predetermined distance D1, and an edge or cutting surface of the second cutting device 520 is raised by a predetermined distance D2 relative to an edge or cutting surface of the first cutting device 530. For instance, distance D1 can be generally equal to the width W3 in FIG. 3, from about 0.12 in. to about 1 in. [about 0.3 cm to about 2.5 cm]). In some embodiments, the distance D1 from slit 104 to the end of the corner board may be about 0.5 cm to about 2 cm. For example, the distance from the slit 104 to the end of the corner board (which may be predetermined) is about 0.37 in. (e.g., about 1 cm) when the corner board 100 has a thickness of about 0.16 in. (e.g., 0.6 cm) or greater. However, one skilled in the art will readily understand that the distance D1 can be any suitable distance that achieves the objectives of the present invention. The distance D2 is generally calculated according to the formula [W1−L2] sin θ, where θ=[180°−α]/2, and W1, L2 and α are as described herein (e.g., W1 is the width of a side of the corner board, L2 is the length or depth of flaps 103*a* and/or 103*b* on each side of the corner board, and α is the angle of the bend in the corner board).

FIG. 6B shows a top down view of a table top 540 with a cutout 545 therein. The table top 540 is the surface along which one or more corner board stock pieces are fed (e.g., along a direction substantially perpendicular to the cutout 545), and the cutout 545 is an area where the first cutting device 530 (e.g., a radial saw blade) moves laterally during the process of cutting the corner board 100. Generally, the width of the table top 540 depends on the number of pieces of corner board stock being fed and cut. Typically, when one piece (or length) of corner board stock is fed and cut, the table top 540 is about 2 ft. to about 4 ft. wide. When two pieces (or lengths) of corner board stock are cut, the width of the table top 540 is generally about 2.5 ft. to about 5 ft. Furthermore, the length of the table top should be sufficient to enable a radial saw or other cutting apparatus to cut the fed corner board stock (e.g., about 3 ft. to 6 ft. or more). Typically, the width of the cutout 545 may be about 0.5 in. to about 2 in. The length and width of the cutout 545 is sufficient for the blade(s) of the cutting apparatus to cut the corner board and clear the corner board on both sides. Generally, the length of the cutout 545 may be about 8 in. to about 24 in. (e.g., about 12 in. to about 16 in.), and the width of the cutout 545 may be about 0.5 in. to about 4 in. (e.g., about 1 in. to about 2 in).

Figure 6C:
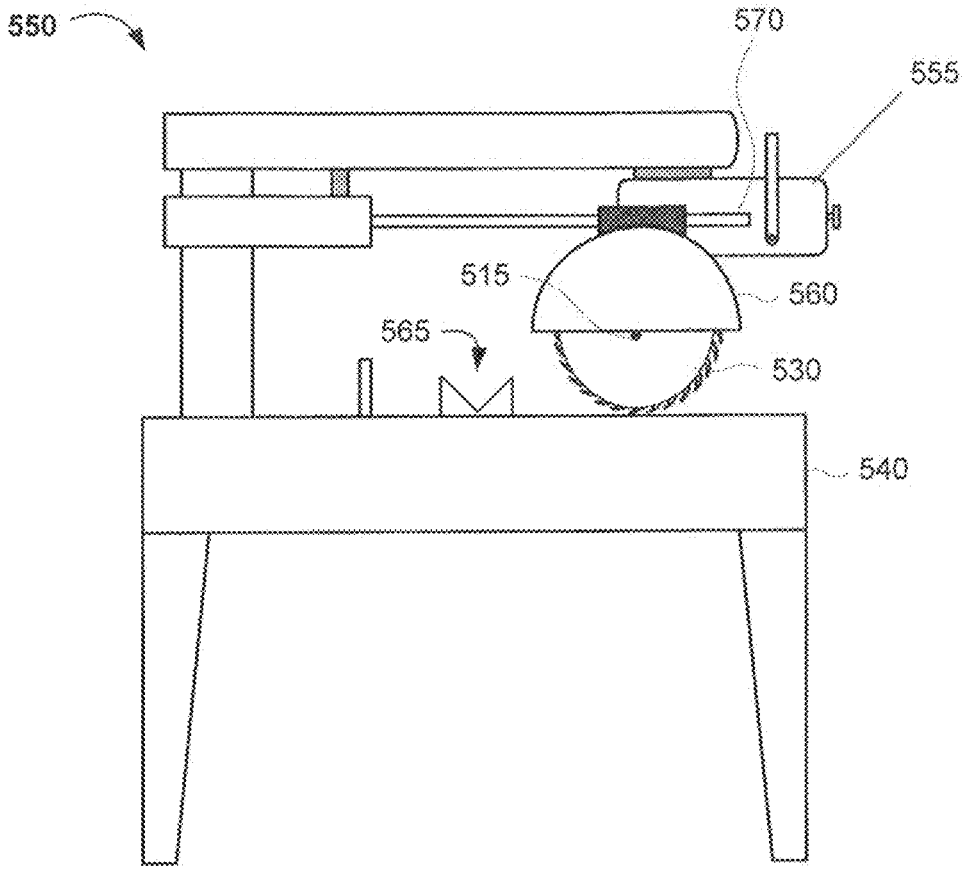

FIG. 6C shows a front view of a cutting apparatus 500 for making slit 104 to create flaps 103*a*, 103*b* on corner boards in accordance with embodiments of the present invention. The apparatus 500 includes corner board holder 565, an outer radial saw blade 530 (i.e., the first cutting device) with a saw blade cover 560 attached to support (e.g., a radial arm) 570. As illustrated in FIG. 6C, corner board holder 565 conforms to the general shape of the corner board 100 and is adapted to secure the corner board in place for procedures performed by the first cutting device 530 and/or the second cutting device 520 (not visible in FIG. 6C). In one embodiment, corner board holder 565 is integrated, fixed or secured to the table top 540. The first cutting device 530 and the second cutting device 520 may be attached to a shaft, rod or other device defining a radial axis (e.g., shaft 510, FIG. 6A) that is driven or rotated by a motor in housing 555. The support 570 is generally configured to allow the first cutting device 530 and second cutting device 520 to move laterally across the corner board. As shown in FIGS. 6A and 6C, the cut across the corner board and the slit into the corner board may be made simultaneously. In one embodiment, when a first corner board is cut into a section (e.g., a free-standing corner board), a slit is formed simultaneously in the next corner board. Alternatively, when the corner board is cut into a section, a slit is formed simultaneously in the same corner board.

In various embodiments, the cuts and slits are made automatically via computer controlled movement of the radial arm saw across the corner board stock at predetermined intervals, as the corner board stock is fed along the table top 540 at a predetermined rate (e.g., 1-10 ft/s, or any rate or range of rates therein). In one embodiment, there may be a cut-out or gap in the holder 565 for the blade(s) to pass through.

In a further embodiment, the apparatus 550 further comprises an attachment mechanism that allows one or more attachments to be attached to the cover 560 and/or table top 540. Such attachments can comprise an air ram, air jet, air press, punch or other thrusting device, etc., for folding flaps 103*a*-103*d*. In some embodiments, the punch or other thrusting device comprises a roller or a rounded metal projection (e.g., attached to and/or moved by a hydraulic cylinder or solenoid). Thus, the inwardly extending material (e.g., flaps 103*a* and/or 103*b*) may be created using equipment that does not come into direct contact with the corner board, which may improve the run time of the equipment between maintenance or repair procedures. In some embodiments, the attachment is configured to form the first flap simultaneously with or immediately after the first cutting device cuts the board stock and the second cutting device forms the slit. Alternatively, the flaps (e.g., 103*a*, 103*b*) may be folded manually (e.g., prior to use) or automatically (e.g., using an automated folding machine) in a separate procedure.

Figure 7:
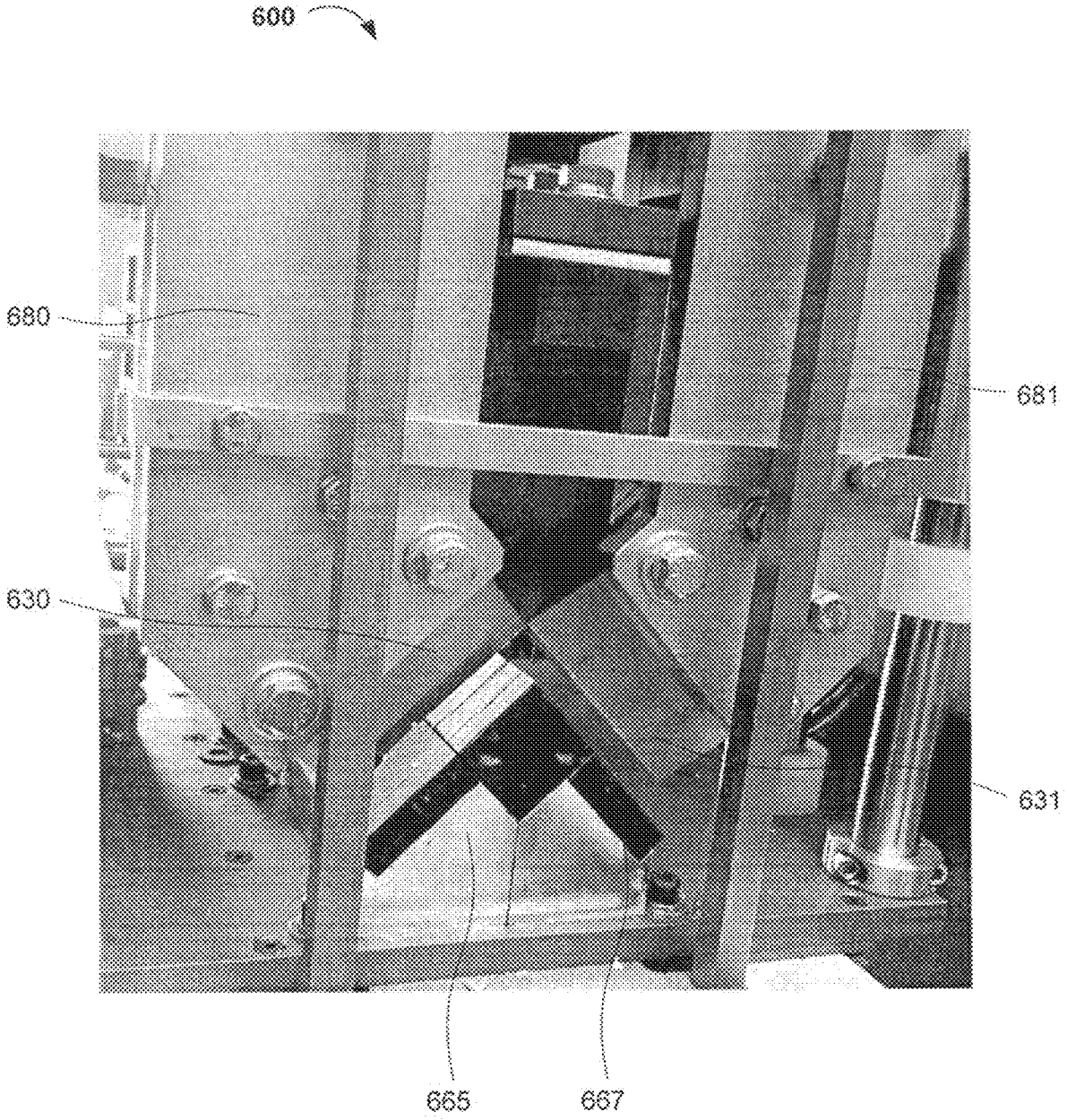
FIG. 7 is a front view of an exemplary apparatus or machine for manufacturing the corner boards of FIGS. 1A-3, in accordance with embodiments of the present invention.

FIG. 7 is a front view of another exemplary apparatus or machine 600 for manufacturing the corner boards of FIGS. 1A-3, in accordance with embodiments of the present invention. The apparatus or machine 600 includes a plurality of first cutting tools 630, 631 (e.g., knives, blades, etc.), and a corner board holder 665 having a support block 667. The first cutting tools 630 and 631 are secured to supports 680 and 681 (e.g., with bolts and nuts, but optionally, by screws, welding, etc.) that are raised and lowered (e.g., using a conventional piston-based motor; not shown). The first cutting tools 630 and 631 are positioned at an angle that matches that of the support block 667 and the corner board (not shown).

Additionally, exemplary embodiments may have at least one second cutting tool (not shown) behind each of the first cutting tools. The first second cutting tools may be configured to cut the slits 140 in the corner boards of FIGS. 1A-3. As a result, the second cutting tools may be offset from (e.g., behind) the first cutting tools 630, 631 by a distance L2 (see FIG. 1A) or W3 (see FIG. 3), or orthogonal to and offset from the edge of the support block 667 by a distance W4 (see FIGS. 4A-B) when the support block 667 has the same width dimension(s) as the corner board.

An Exemplary Method of Manufacturing Slit and/or Flaps for Corner Boards

Another aspect of the present invention relates to a method of manufacturing corner boards having a slit 104 and/or flaps 103*a*/103*b* and/or 103*c*/130*d* in accordance with embodiments of the present invention. An exemplary method of manufacturing such corner boards (e.g., the corner boards of FIGS. 1A-B and 3) is described below.

In one embodiment, the method of manufacturing a corner board comprises bending a board stock to form first and second sides of the corner board, cutting the board stock into fixed lengths, and forming a slit near or adjacent to a first end of the corner board. The first and second sides of the corner board have an angle therebetween. Typically, this angle is about 90°. Also, the bent and cut board stock forms the corner board. In a further embodiment of the method, flaps 103*a* and/or 103*b* are formed at, on, in, from, near or adjacent to the first end of the corner board.

Figure 8:
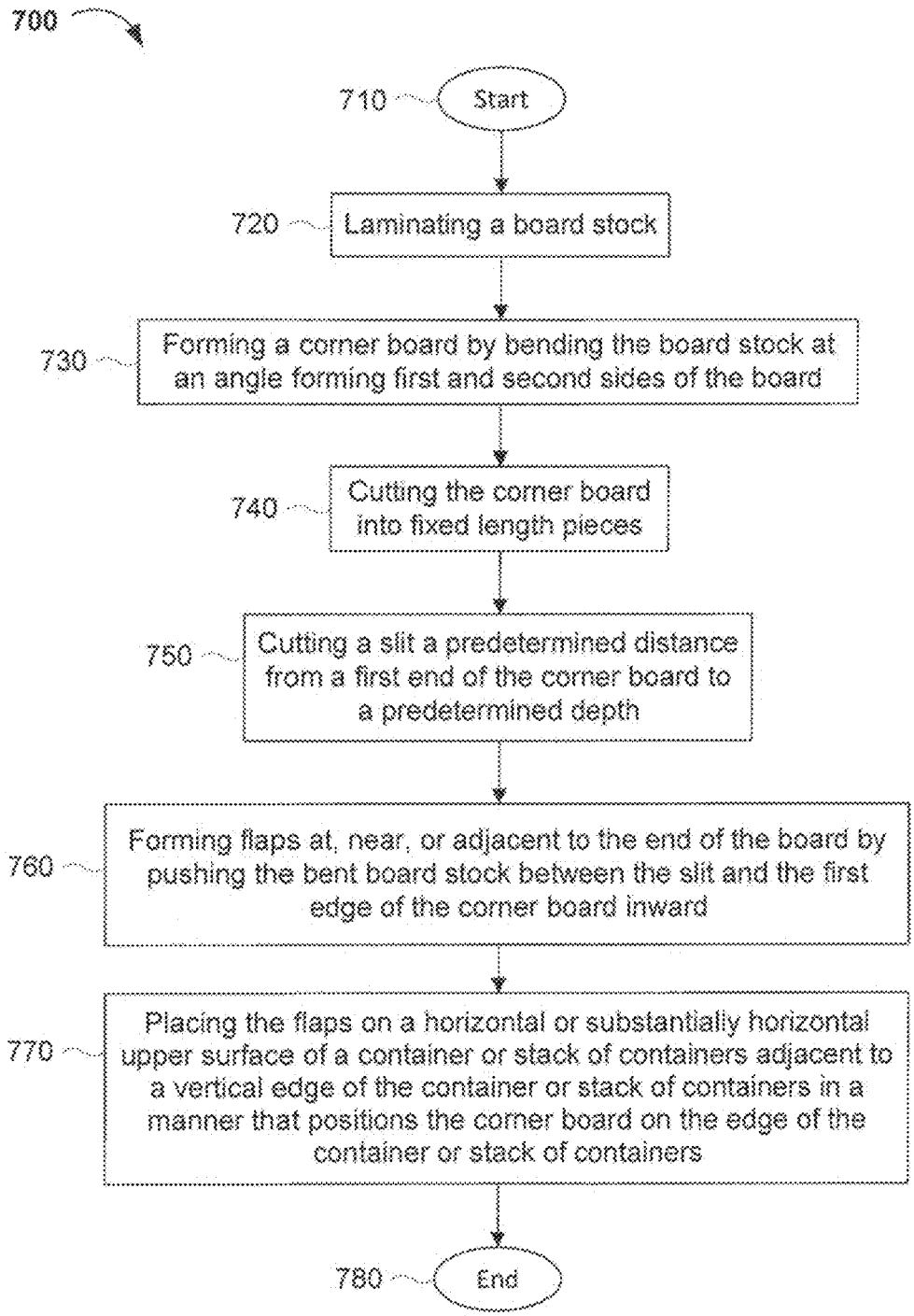
FIG. 8 is a flow chart of an exemplary method of manufacturing the corner boards of FIGS. 1A-3, in accordance with one or more embodiments of the present invention.

FIG. 8 shows a flow chart 700 of an exemplary method of manufacturing a slit and/or flaps in a corner board (e.g., corner board 100 of FIG. 1A) in accordance with embodiments of the present invention. The method of manufacturing a slit corner board generally comprises forming a slit 104 near, in or at one end of the corner board 100, and the method of forming a flap in or on the corner board generally further comprises folding the board material at the end of the corner board 100 between the slit 104 and the end of the corner board. Typically, the material is folded inwardly (e.g., towards the small angle between the sides of the corner board and/or towards the bend).

Referring back to FIG. 8, the method starts at 710, and at 720, board stock is laminated with one or more layers of paper and/or plastic. The board stock may comprise a pre-laminated corner board stock, comprising a plurality of layers of paper, and optionally one or more layers of plastic, adhesively laminated to one or two adjacent layers of paper and/or (when present) plastic. In various embodiments, the blank (e.g., board stock cut or formed to a predetermined width) may comprise alternating layers of paper or other feed stock and adhesive, folded to the desired angle $\alpha$.

In further embodiments, the corner board comprises layers of paper and/or other feed stock with uncured (i.e., wet or damp) adhesive between the layers. In such embodiments, the method may further comprise drying the corner board. For instance, if the material is a multi-ply paperboard, pressboard, or cardboard, the curing time will provide time for the adhesive (e.g., glue) between the layers to cure or dry. Providing a suitable curing period may allow for easier manipulation of the corner board during its manufacture as well as providing increased strength and/or durability of the corner board during use. In some embodiments, the curing period may depend on the time of year. For instance, during winter months when the temperatures are cooler, it may take 10-14 days for the corner boards to cure, whereas it may take about 3-4 days during the warmer summer months.

At 730, a corner board 100 is formed by bending the board stock at a first angle $\alpha$, forming first and second sides (see, e.g., sides 101, 102 of FIG. 1A) of the corner board 100. Alternatively, a preformed corner board having two sides 101, 102 at first angle $\alpha$ running the length of the corner board material may be used. Generally, the corner board has a first angle $\alpha$ of about 90°.

At 740, the corner board 100 is cut into fixed-length pieces. The fixed-length pieces may have a predetermined length (e.g., L1 in FIG. 1A) of about 24 in. (60 cm) to about 90 in. (230 cm). However, it should be readily understood that the predetermined length (e.g., L1 in FIG. 1A) of the sides (e.g., 101, 102 in FIG. 1A) of the corner board 100 can be any value in the range, or more or less than such a range.

At 750, the slits 104 are cut at a predetermined distance (e.g., width W3 in FIG. 3) from the end of the corner board 100. For example, the predetermined distance may be from about 0.3 cm to about 3 cm, or any value therein. Each slit 104 is generally cut into each side (101, 102 in FIG. 1A) of the corner board 100 to a predetermined depth (e.g., length L3 in FIG. 3) from the point of origin of the first angle $\alpha$. The distance W3 may be about 0.3 cm to about 3 cm. Simultaneous formation of slits 104 and cuts of the corner board may be performed as discussed above. In one embodiment, a first corner board is cut into a section and a slit is formed in the next corner board simultaneously. In a further embodiment, the cuts are made and the slits are formed automatically via computer controlled movement of a "dual purpose" cutting apparatus across the corner board stock, at predetermined intervals as the corner board stock is fed into the apparatus (e.g., 500 in FIG. 6C) at a predetermined rate (e.g., 1-10 ft/s).

The corner board 100 and the slit 104 may be cut using any capable cutting tool (e.g., a first cutting device), such as a knife blade, a laser, a saw, including a radial saw, or a water jet. In one embodiment, the tool for cutting the corner board and forming the slit includes two substantially side-by-side cutting devices or first and second orthogonal cutting devices. The second cutting device may also be selected from the group consisting of a knife blade, a laser, a saw (e.g., a radial saw), or a second water jet. In such an example, the beam and/or blade(s) that cut the corner board and form the slit are offset from each other (e.g., spaced apart by distance W2), with the edge of the first cutting device (blade, beam, or other slit-forming tool) that cuts the slit raised by distance [W1−L2] sin $\theta$, where $\theta=[180°-\alpha]/2$ (and W1, L2 and $\alpha$ are as described herein), and an edge or cutting surface of the second cutting device is raised by a second distance relative to an edge or cutting surface of the first cutting device. Alternatively, slits 108 in the end of the corner board 400 (see FIG. 4A) can be formed manually or by automated equipment (e.g., an automatic saw, knife blade, punch, laser, water jet). Generally, the slits 108 are formed in a separate procedure from cutting the corner boards into predetermined lengths.

At 760, the flaps are formed at, near, or adjacent to the end of the board 100 by pushing or otherwise forcing the material of the bent board stock between the slit 110 and the cut end of the corner board 100 inward at a second angle $\alpha'$ towards the first angle and/or edge of the corner board. The flaps may be formed manually or automatically, and in the latter case, either substantially simultaneously with formation of the slits or subsequently to formation of the slits. For example, the flaps may be formed by pushing the bent board stock between the first slit and the first end of the corner board inward (e.g., towards the center of the board). In preferred embodiments, the first angle may be, but is not limited to about 90°, and the first flap may be at a second angle of about 30° to 150° (but not limited thereto) with respect to at least one side of the corner board.

To use the mountable corner boards, at 770, the flaps are placed on a horizontal or substantially horizontal upper surface of a container or stack of containers, adjacent to a vertical edge of the container or stack of containers in a manner that positions the corner board 100 on the edge of the container or stack of containers.

Alternatively and/or additionally, a plurality of stacked containers using the corner board may be secured by placing the first flap of the corner board on an uppermost corner of a stack of containers, items, and/or objects, wherein the first flap secures the corner board against the stack of containers, items, and/or objects. A second flap of the corner board may be placed on the uppermost corner of the stack of containers, items, and/or objects to secure the corner board against the stack of containers, items, and/or objects. Subsequently, the stack of containers, items, and/or objects are wrapped or banded with a wrapping or banding material. At 780, the method ends.

CONCLUSION/SUMMARY

Embodiments of the present invention can advantageously provide a corner board that may be rested or placed along a vertical edge of a container or stack of containers, without the need for additional materials or steps (e.g., staples or tape) to affix the corner board to the container or stack of containers. Thus, the present corner board advantageously holds the container stacks in place when the stack is wrapped with appropriate wrapping material, and eliminates and/or minimizes the need for additional material, the risk of injury to the user and/or damage to the containers or materials therein, and cost and expenses associated therewith.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching(s). The embodiments were chosen and described in order to best explain the principles of the invention and its practical application(s), to thereby enable others skilled in the art to best utilize the invention and various embodiments with various modifications as are suited to the particular use contemplated. It is intended that the scope of the invention be defined by the claims appended hereto and their equivalents.

What is claimed is:

1. A corner board, comprising:

first and second sides, each comprising a board material, each of the first and second sides having a thickness of about 0.2 cm to about 1.3 cm;

a bend between the first and second sides, joining the first and second sides together; and a first slit in an outer edge of the corner board and near or adjacent to a first end of the corner board, or in the first end of the corner board, forming a first flap adapted to place, set, or rest the corner board on an uppermost surface of a stack of containers.

2. The corner board of claim 1, wherein the board material comprises paper, cardboard, pressed and/or corrugated cardboard, fiberboard, paperboard, boxboard, containerboard, plastic, or any laminate or other combination thereof.

3. The corner board of claim 1, wherein each of the first and second sides has a length of about 20 cm to about 90 cm and a width of about 2.5 cm to about 10 cm.

4. The corner board of claim 1, wherein each of the first and second sides have an identical width, and the slit has a depth of about 20-50% of the width of each of the first and second sides.

5. The corner board of claim 1, wherein the first flap extends inwardly towards the bend.

6. The corner board of claim 5, wherein the bend has a first angle of about 90°, and the first flap is at a second angle of about 30° to 150° with respect to the first side of the corner board.

7. The corner board of claim 1, wherein the first flap allows the corner board to contact a vertical edge of the container or stack of containers, or the first and second sides of the corner board to contact vertical sides of the container or stack of containers adjacent to the vertical edge of the container or stack of containers.

8. The corner board of claim 1, further comprising a second slit near, adjacent to, or in the first end of the corner board, forming a second flap adapted to place, set, or rest the corner board on the container or stack of containers.

9. The corner board of claim 1, further comprising a second slit, near, adjacent to, or in the first end of the corner board, forming a second flap adapted to set, place, or rest the corner board on the surface, wherein the second slit comprises a distance from a long edge along a width of a side of the corner board to the second slit.

10. A method of securing a plurality of stacked containers using the corner board of claim 1, comprising:

placing the first flap of the corner board on an uppermost corner of a stack of containers, items, and/or objects, wherein said first flap secures the corner board against the stack of containers, items, and/or objects; and wrapping or banding the stack of containers, items, and/or objects with a wrapping or banding material.

11. The method of claim 10, further comprising placing a second flap of the corner board on the uppermost corner of the stack of containers, items, and/or objects, wherein said second flap secures the corner board against the stack of containers, items, and/or objects.

12. The corner board of claim 9, wherein the second flap is at a third angle of about 30° to 150° with respect to the second side of the corner board.

13. The corner board of claim 12, wherein each of said first and second flaps has a length of about 0.3 cm to about 2.5 cm.

14. The corner board of claim 13, wherein the length of the first and second sides of the corner board is about 60 cm to about 150 cm.

15. The corner board of claim 14, wherein when the length of the first and second sides of the corner board is about 60 cm to 120 cm, the length of the first and second flaps is about 0.3 cm to about 1.3 cm, and when the length of the first and second sides of the corner board is 120 cm to about 150 cm, the length of the first and second flaps is about 0.95 cm to about 2.5 cm.

16. The method of claim 11, wherein the second flap is at a third angle of about 90° to 150° with respect to the second side of the corner board.

17. The method of claim 11, wherein each of said first and second flaps has a length of about 0.3 cm to about 2.5 cm.

18. A corner board, comprising:

first and second sides, each comprising a board material;

a bend between the first and second sides, joining first and second sides together; and a first slit in an outer edge of the corner board and near or adjacent to a first end of the corner board, or in the first end of the corner board, wherein the first slit is from about 0.5 cm to about 2 cm from the first end of the corner board when the corner board has a thickness of about 0.6 cm or greater, and from about 0.75 cm to about 3 cm when the corner board has a thickness of less than 0.6 cm, forming a first flap adapted to place, set, or rest the corner board on an uppermost surface of a stack of containers.

19. A corner board, comprising:

first and second sides, each comprising a board material and having an identical width;

a bend between the first and second sides, joining first and second sides together; and a first slit in an outer edge of the corner board and near or adjacent to a first end of the corner board, or in the first end of the corner board, forming a first flap adapted to place, set, or rest the corner board on an uppermost surface of a stack of containers, the first slit having a depth of about 20-50% of the width of each of the first and second sides.

20. A corner board, comprising:

first and second sides, each comprising a board material;

a bend between the first and second sides, joining first and second sides together; and a first slit in an outer edge of the corner board and near or adjacent to a first end of the corner board, or in the first end of the corner board, forming a first flap adapted to place, set, or rest the corner board on an uppermost surface of a stack of containers; and a second slit, near, adjacent to, or in the first end of the corner board, forming a second flap adapted to set, place, or rest the corner board on the surface, wherein the first flap is in the first side, the second flap is in the second side, the second flap has a third angle of about 30° to 150° with respect to the second side of the corner board, the first and second slits are equidistant from a parallel edge of the corner board, and each of the first and second flaps has a length of about 0.3 cm to about 2.5 cm.

* * * * *